United States Patent [19]

Bell

[11] 4,429,944

[45] Feb. 7, 1984

[54] BATTERY POST CLAMP

[76] Inventor: Joseph P. Bell, Rte. 1, Box 262D, Grayslake, Ill. 60030

[21] Appl. No.: 290,476

[22] Filed: Aug. 6, 1981

[51] Int. Cl.[3] ..... H01R 11/11

[52] U.S. Cl. ..... 339/228; 339/261

[58] Field of Search ..... 339/61, 228, 200 P, 339/255 P, 260, 261

[56] References Cited

U.S. PATENT DOCUMENTS 3,740,703 6/1973 Sessions ..... 339/261
3,950,056 4/1976 Bowen ..... 339/59 M
4,178,052 12/1979 Ekbom et al. ..... 339/61 R
4,256,361 3/1981 Bell ..... 339/228

*Primary Examiner*—Joseph H. McGlynn
*Assistant Examiner*—Paula Austin
*Attorney, Agent, or Firm*—Hill, Van Santen, Steadman & Simpson

[57] ABSTRACT

A battery clamp includes a pair of battery terminal clamping members with jaws which are biased closed and manually opened. The clamp, in one embodiment, requires only three parts including the two clamping members and a V-shaped spring which connects, aligns and biases the members. In another embodiment, a plate and two screws are added for mechanical cable attachment.

3 Claims, 5 Drawing Figures

FIG. 1
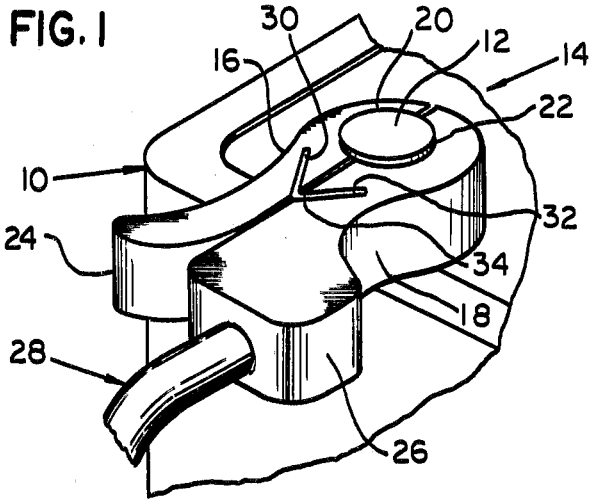
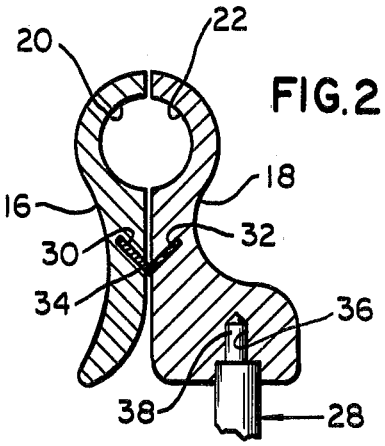
FIG. 2
FIG. 3
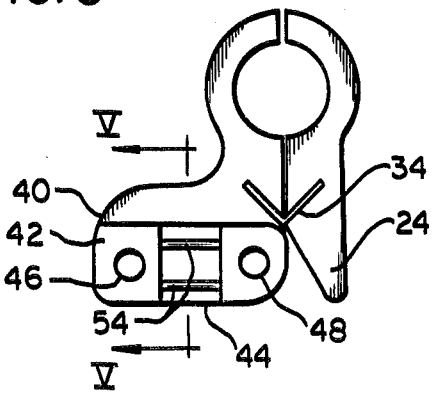
FIG. 4
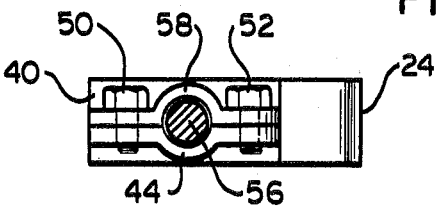
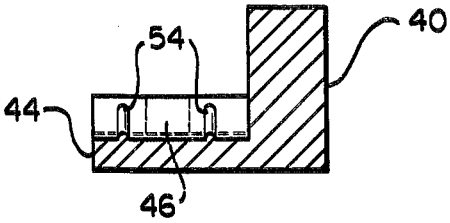
FIG. 5

BATTERY POST CLAMP

BACKGROUND OF THE INVENTION

1. Field of the Invention

The present invention relates to battery terminal clamps, and more particularly to battery terminal clamps in which a single spring member is employed for effecting the clamping action and preventing misalignment due to relative twisting movement between two clamp members.

2. Description of the Prior Art

Clamp structures employing two separate clamping members have been disclosed in, for example, U.S. Pat. Nos. 2,285,545 and 2,020,220. Both of these arrangements employ two clamp members and utilize springs for providing clamping forces on a battery terminal or the like. However, both of these structures require tools to effect a disconnection or connection. In U.S. Pat. No. 2,285,545, a screwdriver or similar tool is required, for disposition between the two, free ends of the clamp members adjacent the jaws of the same, whereby the latter may be separated by twisting the blade of the screwdriver. In U.S. Pat. No. 2,020,220, provision is made for engagement with a pair of pliers or the like at the opposite free ends of the clamping member to effect compression of the actuating spring and open the jaws.

In my U.S. Pat. No. 4,256,361 I provide a battery terminal clamp which is designed so that it may be mounted or detached without the necessity of tools and which is simple in construction and employs only four pieces of simple design, with the construction being such that the jaws are effectively maintained in alignment and readily capable of being disposed in an open relationship to permit disconnection from a terminal or application to a terminal.

SUMMARY OF THE INVENTION

The object of the present invention is to provide an improved battery terminal clamp based on the structure disclosed in may aforementioned U.S. Pat. No. 4,256,361 in which the number of elements is reduced while maintaining all of the operational functions of the clamp.

The above object is achieved by providing a single flat V spring which effects the clamping forces of my previous spring structure and which also prevents twisting movement between the two clamp members, previously the function of a separate thin flat strip.

BRIEF DESCRIPTION OF THE DRAWING

Other objects, features and advantages of the invention, its organization, construction and operation will be best understood from the following detailed description, taken in conjunction with the accompanying drawing, on which:

FIG. 1 is a perspective view of a battery clamp constructed in accordance with the present invention and illustrated in its mounted position on a battery terminal;

FIG. 2 is a fragmentary sectional view of the clamp illustrated in FIG. 1;

FIG. 3 is a plan view illustrating an alternate construction for securing a conductor to the clamp;

FIG. 4 is an end view of the structure of FIG. 3, further showing a conductor clamping plate; and FIG. 5 is a sectional view taken substantially along the line V—V of FIG. 3.

DESCRIPTION OF THE PREFERRED EMBODIMENTS

Referring to FIGS. 1 and 2, a portion of the battery 10 is illustrated as including a battery terminal 12. A battery terminal clamp 14, constructed in accordance with the invention, is illustrated mounted on the battery terminal 12.

The battery terminal clamp 14 comprises a first clamping member 16 and a second clamping member 18 which respectively include a substantially semi-circular recess 20 and 22 for cooperably receiving and engaging the battery terminal 12. The clamping members 16 and 18 are further illustrated as comprising respective portions 24 and 26 which serve as a handle for the battery clamp and which, when squeezed toward each other, effect a parting of the jaws for mounting or dismounting the clamp.

As is evident, the mounting or dismounting action involves pivoting around a generally central point of the entire structure. The pivoting action, the securement of the two clamping members 16 and 18, and the provision for alignment of the clamping members 16 and 18 are all accomplished by a V spring 34 whose legs are received in respective slots 30 and 32 in the clamping members 16 and 18. The spring 34 may be, for example, a 0.40 stainless steel member which is press fit into the slots 30 and 32.

As best illustrated in FIG. 2, a conductor 28, for example a battery cable, is connected to the portion 26 of the clamping member 18, that portion being of greater dimensions than the cooperable portion 24. In order to attach the cable 28, the portion 26 is provided with a bore 36 for receiving the conductor 38 of the cable 28. The conductor can be secured by any suitable means, such as soldering, swedging or other means.

Referring to FIGS. 3–5, a modified form of cable mounting is illustrated in which the enlarged portion of the handle is referenced 40 and is illustrated as being shaped and worked to provide a generally flat plate portion 42 which includes, centrally thereof, a saddle portion 44. The portion 42 includes threaded bores 46, 48 for receiving screws 50, 52, while the saddle portion 44 includes a pair of upstanding ribs 54 (FIG. 5) for increasing the area of electrical connection to a conductor 56. A plate 58 of similar shape includes a pair of apertures 60, 62 for receiving the screws 50, 52, respectively, and may preferably be recessed apertures.

With the exception of the attachment of the battery cable, it is readily apparent that the embodiments of the invention, in an inventive contrast to that of my U.S. Pat. No. 4,256,361, comprise only three parts, one of which, namely the V spring, performs three functions, including (1) connecting the two clamping members, (2) effecting the spring clamping action for the clamping members with respect to a terminal, and (3) aligning the two clamping members to effectively prevent twisting movement between the same.

Although I have described my invention by reference to particular illustrative embodiments thereof, many changes and modifications of the invention may become apparent to those skilled in the art without departing from the spirit and scope of the invention. I therefore intend to include within the patent warranted hereon all such changes and modifications as may reasonably and properly be included within the scope of my contribution to the art.

I claim:

1. In a battery terminal clamp of the type in which a pair of conductive clamping members have cooperable recesses for engaging a battery terminal and the clamping members are pivoted at and biased towards a grouping relationship with respect to a battery terminal by a spring and are maintained in alignment by an alignment member coupling both clamping members together, the improvement therein of maintaining the functions of the spring and alignment member while combining the same in a single element, comprising:

a V-shaped spring connecting both clamping members and providing a holding connection therebetween, while simultaneously providing the bias and the alignment of the clamping members, a slot in each of said clamping members, and said V-shaped spring including a pair of flat legs each press fit in a respective slot.

2. The improved battery terminal clamp of claim 1, wherein:

one of said clamping members includes contacting means for receiving and electrically contacting a conductor.

3. The improved battery terminal clamp of claim 2, wherein said contacting means comprises:

a ridged surface; and a clamping plate secured to said one clamping member for clamping the conductor against said ridged surface.

* * * * *